US007793366B2

(12) United States Patent
Stoltzfus

(10) Patent No.: US 7,793,366 B2
(45) Date of Patent: Sep. 14, 2010

(54) COMBINED WALL TREATMENT AND BED

(76) Inventor: Nathan Lee Stoltzfus, 30 Adams St., Somerville, MA (US) 02145

( * ) Notice: Subject to any disclaimer, the term of this patent is extended or adjusted under 35 U.S.C. 154(b) by 263 days.

(21) Appl. No.: 11/892,861

(22) Filed: Aug. 28, 2007

(65) Prior Publication Data

US 2008/0052824 A1 Mar. 6, 2008

Related U.S. Application Data

(60) Provisional application No. 60/840,707, filed on Aug. 29, 2006.

(51) Int. Cl.
*A47C 17/38* (2006.01)

(52) U.S. Cl. ..... 5/136; 5/133; 5/159.1; 5/907

(58) Field of Classification Search ..... 5/130, 5/136–144, 159.1, 160, 169.1, 133, 161, 5/164.1, 907
See application file for complete search history.

(56) References Cited

U.S. PATENT DOCUMENTS

| | | | | |
|---|---|---|---|---|
| 151,020 | A | 5/1874 | Harrison et al. | |
| 182,544 | A | 9/1876 | Arnaud | |
| 187,454 | A * | 2/1877 | Caulier | 5/144 |
| 233,484 | A | 10/1880 | Doring | |
| 242,961 | A | 6/1881 | Nelson | |
| 246,097 | A | 8/1881 | Doring | |
| 253,768 | A | 2/1882 | Saxton | |
| 254,501 | A | 3/1882 | Ortlieb | |
| 260,346 | A | 6/1882 | Zimmerman | |
| 675,702 | A | 6/1901 | Adams | |
| 780,569 | A | 1/1905 | Mackenzie | |
| 1,015,318 | A | 1/1912 | Javins | |
| 1,113,144 | A | 10/1914 | Souter | |
| 1,303,875 | A | 5/1919 | Fowler | |
| 1,610,956 | A | 12/1926 | Lannom | |
| 2,577,223 | A | 12/1951 | Woller | |
| RE23,996 | E * | 5/1955 | Sieminski | 108/48 |
| 2,747,202 | A | 5/1956 | Driver | |
| 2,770,813 | A | 11/1956 | Marzillier | |
| 2,779,032 | A | 1/1957 | Van Der Sluys | |
| 2,788,528 | A * | 4/1957 | Hansen | 5/6 |
| D191,272 | S | 9/1961 | Ungaro | |
| 3,046,572 | A * | 7/1962 | Eames et al. | 5/136 |
| 3,133,510 | A | 5/1964 | Maraventano | |
| 3,602,569 | A | 8/1971 | Caputo | |
| 3,999,245 | A | 12/1976 | Bue et al. | |
| 4,694,518 | A | 9/1987 | Lukich et al. | |
| 4,736,476 | A | 4/1988 | Maqueira | |
| 4,766,623 | A | 8/1988 | Beihoffer et al. | |
| 4,793,011 | A | 12/1988 | Eve | |
| 5,036,558 | A | 8/1991 | Lameka et al. | |

(Continued)

*Primary Examiner*—Peter M Cuomo
*Assistant Examiner*—Nicholas Polito
(74) *Attorney, Agent, or Firm*—Scott E. Kamholz; Foley Hoag LLP

(57) ABSTRACT

A combined wall treatment and bed, that is, a unit which resembles a decorative wall treatment, such as a painting, when in the upright and stowed position, but which can be lowered to provide a comfortable bed. When the unit is in the upright and stowed position its appearance is that of a thin (4½") wall treatment, the thickness of a large painting, and thus consumes practically no living space. A fixed component can be attached to any standard wall construction without modification; it supports the lower edge of a movable portion and defines an axis about which the movable portion pivots to provide a functional and comfortable bed.

20 Claims, 8 Drawing Sheets

U.S. PATENT DOCUMENTS

| | | | | |
|---|---|---|---|---|
| 5,101,523 | A | 4/1992 | Bright | |
| 5,136,737 | A | 8/1992 | Reppas et al. | |
| 5,446,932 | A * | 9/1995 | Voorhis | 5/137 |
| 5,513,574 | A | 5/1996 | Collins | |
| 6,401,276 | B1 * | 6/2002 | Sherman | 5/136 |
| 6,405,392 | B2 | 6/2002 | Schwalbe, Jr. | |
| 6,507,962 | B2 | 1/2003 | Thurston | |
| 6,508,526 | B2 | 1/2003 | Reppas et al. | |
| 6,684,433 | B2 * | 2/2004 | Giori et al. | 5/709 |
| 6,691,342 | B2 * | 2/2004 | Sherman | 5/136 |
| 7,013,506 | B2 * | 3/2006 | Revels | 5/149 |
| 2005/0055770 | A1 | 3/2005 | Reppas et al. | |

* cited by examiner 34
170
152
15
154
156
164
168
42
150
162
160
46
40
15

164
170
42
164
152
172
150
59
156
154
162
160
46

W
26
16
134
35
34
34
35
14
30
16
24

59
62
34
180
46
34
62
59
178
182
42
42
44
11
11
120
30
40
174
26
48
54
10
82
50
54
56
56
55
54
176
52
54
88
55
58
84
86
22

212
208
202
34
208a
206
210

212
202
17
17
204
34
34
34
214
200
214
18
234
52
232
230
18

COMBINED WALL TREATMENT AND BED

CROSS-REFERENCE TO RELATED APPLICATION

This application claims priority from provisional application Ser. No. 60/840,707, filed Aug. 29, 2006.

FIELD OF THE INVENTION

This present invention relates generally to a combined wall treatment and bed, that is, to a piece of furniture which can be readily converted from a thin, attractive wall treatment to a comfortable bed.

BACKGROUND OF THE INVENTION

Convertible furniture has long been known as a way to conserve floor and living space while providing temporary sleeping accommodations. It appears that William L. Murphy invented what is commonly known as the "Murphy bed" or the "wall bed" (these terms being used interchangeably herein) in the early 1900's, and versions of his design are still used today. The basic Murphy bed consists of a bed frame with a standard mattress. The bed frame pivots about an axis at or near the head of the bed from a stowed position in which the frame and mattress are juxtaposed to the wall to a horizontal sleeping position. To assist the user in raising and lowering the bed, these beds generally employ a system of torsion or extension springs to counterbalance the weight. Most of these beds are enclosed in a cabinet-type stationary furnishing enclosure that hides the bed, provides attachment to the floor and/or wall, and provides a structure from which to hinge the bed and the counterbalance system.

Although the basic concept of the Murphy or wall bed has not changed a great deal since the early versions, a number of patents listed below show that development has continued in two primary areas: First, since the beds to date are quite heavy many attempts have been made to find improved ways to suspend the weight of the bed as it is pulled down off the wall. Secondly, since the Murphy beds to date are relatively large pieces of furniture, numerous attempts have been made to convert them into more useful furnishings when in a stowed position.

The following patents are generally relevant to the subject matter of this invention:

U.S. Pat. No. 182,544 Sep. 26, 1876 D. Arnaud

U.S. Pat. No. 675,702 Jun. 4, 1901 Adams

U.S. Pat. No. 1,015,318 Jan. 23, 1912 Javins

U.S. Pat. No. 2,747,202 May 29, 1956 Driver

U.S. Pat. No. 3,999,245 Dec. 28, 1976 Bue et al.

U.S. Pat. No. 4,694,518 Sep. 22, 1987 Lukich et al

U.S. Pat. No. 4,766,623 Aug. 30, 1988 Beilhoffer et al.

U.S. Pat. No. 5,036,558 Aug. 6, 1991 Lameka et al.

U.S. Pat. No. 5,136,737 Aug. 11, 1992 Reppas

U.S. Pat. No. 5,446,932 Sep. 5, 1995 Voorhis

U.S. Pat. No. 6,405,392 Jun. 18, 2002 Schwalbe, Jr.

U.S. Pat. No. 6,508,526 Jan. 21, 2003 Reppas

Since, as noted, the design of Murphy or wall beds has not changed significantly through the years, certain fundamental limitations on the basic design of the Murphy bed, as generally exemplified by one or more of the patents listed above, remain as follows: (1) Existing wall beds still take up a significant amount of floor space, generally between 18" to 24" from the wall times the width of the bed, or between 6-8 square feet of living space. This is a substantial loss of valuable space in small apartments, for example. Furthermore, such bulky objects cannot be disguised as an attractive wall treatment, for example. (2) Most existing wall beds require fixation to the floor, leaving scars and holes in precious floor finishes or carpets; that is, the weight of standard wall beds makes it structurally impossible to attach them to standard walls without being supported on the floor or requiring modification of the wall structure. (3) Since the existing wall beds have full mattresses and heavy frames it is difficult to engineer counterbalancing systems to assist the lowering of these beds. (4) Since most of the Murphy style beds are 18-24" off the wall and encased in a closet or cabinet structure, while lying in bed one's head is substantially enclosed, giving some a claustrophobic feeling. (5) Since most wall beds are stowed in an armoire/cabinet one needs to open the doors of the cabinet when in a sleep position. This requires space on both sides of the bed into which the doors can be opened. (6) Existing Murphy beds by and large do not have box springs, or if they have a suspension system it is usually a saggy, uncomfortable assembly of wire and springs. (7) Existing Murphy beds do not have a mechanism to slow the rise of the bed as it reaches the vertical, thus creating a situation where fingers could get pinched and the bed could slam against the back of the cabinet. This is especially true since most wall beds are being pulled back vigorously by the counterbalancing mechanism at the top of the pivoting movement. (8) Existing wall beds only rely on the built-in counter balancing system of weights or a spring system to hold the bed in the vertical closed position. If a spring, pulley, or attachment breaks the bed could come down in a dangerous manner.

Thus, there remain many deficiencies in the known wall or Murphy beds.

SUMMARY OF THE INVENTION

The present invention comprises a combined wall treatment and bed, that is, a unit which resembles a decorative wall treatment, such as a painting, when in the upright and stowed position, but which can be lowered to provide a comfortable bed. When the unit is in the upright and stowed position its appearance is that of a thin (typically 4½") wall treatment, the thickness of a large painting, and thus consumes practically no living space. The unit can be attached to the surface of a wall of any standard construction without modification. A fixed portion of the unit is secured to the wall, supporting its lower edge about one foot off the floor and defining an axis about which the movable portion of the unit pivots to provide a functional and comfortable bed. A pair of legs, which are concealed in an upper frame element, automatically articulate out to support the foot of the bed as it reaches the horizontal position. A planar center member disposed between upper and lower frame elements supports and conceals the sleep system; its façade can be decorated with, e.g., wood, cloth, or painted treatments to taste. An adjustable spring system comprising a torsion spring, gas spring, or other like element for storing energy as the bed is lowered and releasing it as it is raised, supports the unit as it is lowered and holds it against the wall in the upright position. A hydraulic damper, preferably with three adjustable stages, may be provided to dampen motion of the unit as it pivots between upright and lowered position. A thin yet very comfortable bed is provided by a sleep system that utilizes a comfortable hybrid air and foam mattress. An electric air handling system automatically inflates the hybrid air and foam mattress as the bed begins its descent and deflates the mattress as the bed is pivoted to the vertical position, and preferably allows for pressure adjustment after the bed is down. The sleep system also uses thin flexible cambered slats to support the mattress, which take up very little space and provide maximum comfort.

More specifically addressing the noted prior art with respect to the advantages provided by the present invention:

As noted above, while existing wall beds save a considerable amount of space as compared to the standard beds which they replace, existing wall beds continue to take up considerable and valuable space (18-24 inches off the wall times the width of the bed, or 6 to 8 square feet). This is a lot of space to be consumed where living space is at a premium, i.e., in circumstances where a wall bed would be desired. This has motivated many inventors to combine wall beds with other useful furniture, in order to better utilize living space. For example, U.S. Pat. No. 675,702 issued to Adams Jun. 4, 1901 and U.S. Pat. No. 5,136,737 issued to Reppas Aug. 11, 1992 combine a wall bed and a sofa. U.S. Pat. No. 2,747,202 issued to Driver May 29, 1956 combine a faux fireplace and a folding bed. U.S. Pat. No. 6,508,526 issued also to Reppas Jan. 21, 2003 combines a wall bed with a computer workstation.

Similarly, in the early invention of D. Arnaud, U.S. Pat. No. 182,544, Sep. 26, 1876, the bed pivots up to create a deep "wardrobe". In U.S. Pat. No. 5,036,558, Aug. 6, 1991, Lameka et al. combined his wall bed with an "imitation fire place" to enhance the wall bed furnishing when it is in the stowed position. Beilhoffer et al., in U.S. Pat. No. 4,766,623, issued Aug. 30, 1988, addresses this problem by designing a suspension system which allows the Murphy bed to be installed in a recess in a wall; of course the recess consumes space instead.

The concern of the floor space consumed by conventional wall beds even when in the closed position was cited in U.S. Pat. No. 5,446,932 entitled "Folding Wall Bed" issued to Voorhis Sep. 5, 1995. Voorhis attempted to reduce this distance from the wall by pivoting the bed frame off the headboard and creating concealing sideboards that hinge down. However, a requirement remains for enough space from the wall for a headboard, counterbalance mechanism, a full mattress, and the façade.

In contrast, the combined wall treatment and bed of the invention is comparatively thin, typically extending only 4½" or less from the wall when in a stowed position, the same dimension as a large painting. Further, as the slim unit of the invention is secured to the wall, not the floor, the floor space around and under the unit is usable. Accordingly, as in the case of a large painting, one need not navigate around this unit when in the stowed position.

As detailed further below, the innovations which allow for the slimness of the combined wall treatment and bed of the invention include a strong, light-weight frame and a sleep system comprising a hybrid foam and air mattress which can be compressed by application of vacuum to approximately 2½" when in a stowed position and inflated to a comfortable 7" when in a sleep position. This air mattress lies atop a thin flexible cambered slat system. Legs hidden in the top frame open automatically as the bed comes down to support the foot of the bed from the floor. Another aspect of the design that allows for the slenderness of the unit of the invention is disposition of the counterbalance mechanism, provided to allow the unit to be easily lowered and raised as desired, behind a concealing frame. The counterbalance mechanism preferably comprises a compact assembly of adjustable gas or torsion springs, and an adjustable damper if needed. The bed when closed appears as an attractive wall treatment by covering the frame with a light, thin, durable panel of suitable design; for example, the panel might comprise an attractive material, such as wood veneer, or support a decorative fabric, painting, poster, or the like.

As noted, known wall beds are often made to be used as, or to resemble, a large piece of furniture, e.g., a sofa, computer workstation, wardrobe, or cabinet. In contrast, the unit of the present invention is not and does not resemble a conventional piece of furniture; it does not rest on the ground or appear at all like a piece of furniture, nor take up floor or practical living space as would a piece of furniture. In the upright position, the unit of the invention appears as a wall treatment, for example, finished wood or painted wall panels, or a framed painting or tapestry which one can change at will to match the general decor. The top frame, concealing the articulating legs, and the bottom frame, concealing the counterbalance mechanism, damper system, air handling system and leg-articulating mechanism, together frame the center of the wall-treatment, which can be decorated in any way imaginable. Thus when one looks at the unit in its upright and stowed position there is nothing mechanical to give away the fact that the unit also functions as a comfortable bed, and the appearance of the desired wall treatment is in no way compromised.

As noted above, the weight of standard wall beds makes it structurally impossible to attach them to standard wall constructions, necessitating that they be supported on the floor, or requiring modification of the wall structure. Securing conventional wall beds to the floor leaves scars and holes in precious floor finishes and carpets. The combined wall treatment and bed of the invention is readily secured to standard wall construction and avoids the scarring of the floor. Walls can much more easily be repaired when moving the unit of the invention than can a floor after movement of the conventional wall beds.

Since existing Murphy beds are designed with heavy frames and heavy full mattresses, elaborate counterbalancing mechanisms are typically provided to assist with this weight during raising and lowering of the bed. Several of the patents noted above relate to solving this problem of providing sufficient counterbalance. For example, Beilhoffer et al., in U.S. Pat. No. 4,766,623, Aug. 30, 1988, addressed this problem by assisting tension springs using a water-filled counterweight and extension springs to counter-balance the significant weight of the bed.

According to the present invention, the frame is made of light weight materials, and the hybrid air/foam mattress is light in weight, as is the cambered slat system; these expedients all reduce considerably the work that the counterbalance mechanism must do. In one embodiment, fully adjustable torsion springs are utilized as energy storage elements of the counterbalance mechanism. In this embodiment a damper is preferably provided to control the motion of the bed as it is raised and lowered, preventing possible injury and ensuring that the bed does not hit the floor loudly when coming down, nor bang into the wall when being lifted. In another embodiment gas springs are used as the energy storage and damping elements; in this case a separate damper is unneeded.

Since numerous of the Murphy beds extend 18-24" from the wall and are encased in a cabinet or wardrobe, while lying in bed one's head is inside the cabinet, giving some a claustrophobic feel. This problem is eliminated according to the invention since the unit need not be concealed or housed in a cabinet of any kind. Further, the fact that this wall bed is not encased in a cabinet allows one to clip on side tables, to hold the guest's necessities. Similarly, because the unit of the invention is not enclosed in a cabinet the sides of the bed are completely open and no space is required to allow cabinet doors to open.

Existing wall beds typically use a common rigid surface to support the mattress, or, if they do incorporate a flexible mattress support, a saggy and uncomfortable wire and spring support is usually provided. In contrast, the combined wall treatment and bed of the invention uses state of the art thin flexible cambered slat technology, as used in most modern European sleep systems. The slats flex to follow movement and the pressure contours of one's body. A combined hybrid inflatable air mattress, preferably including foam in the air bladder with an additional foam topper, provides comfort while being light weight and compactly stored.

Existing Murphy beds do not have a mechanism to slow the rise of the bed as it reaches the vertical stored position, thus creating a situation where fingers could get pinched and the bed could slam against the back of the cabinet. This is especially true since most wall beds are being pulled back vigorously by the counterbalancing mechanism at the top of the pivot arc. The unit of the present invention can be provided with a damper, for example a hydraulic rotary damper, to control the rate of pivoting as the unit rotates toward the vertical stowed position. If gas springs are used as the energy storage element they provide the damping function. This provides a great deal of safety in contrast to existing wall beds, which typically rely on a built-in counter-balancing system comprising sash-type vertically sliding weights or a spring system. If a spring, pulley, or attachment breaks the bed could come down in a dangerous manner.

BRIEF DESCRIPTION OF THE DRAWINGS

The invention will be better understood if reference is made to the accompanying drawings, in which.

DESCRIPTION OF THE PREFERRED EMBODIMENT

Figure 2:
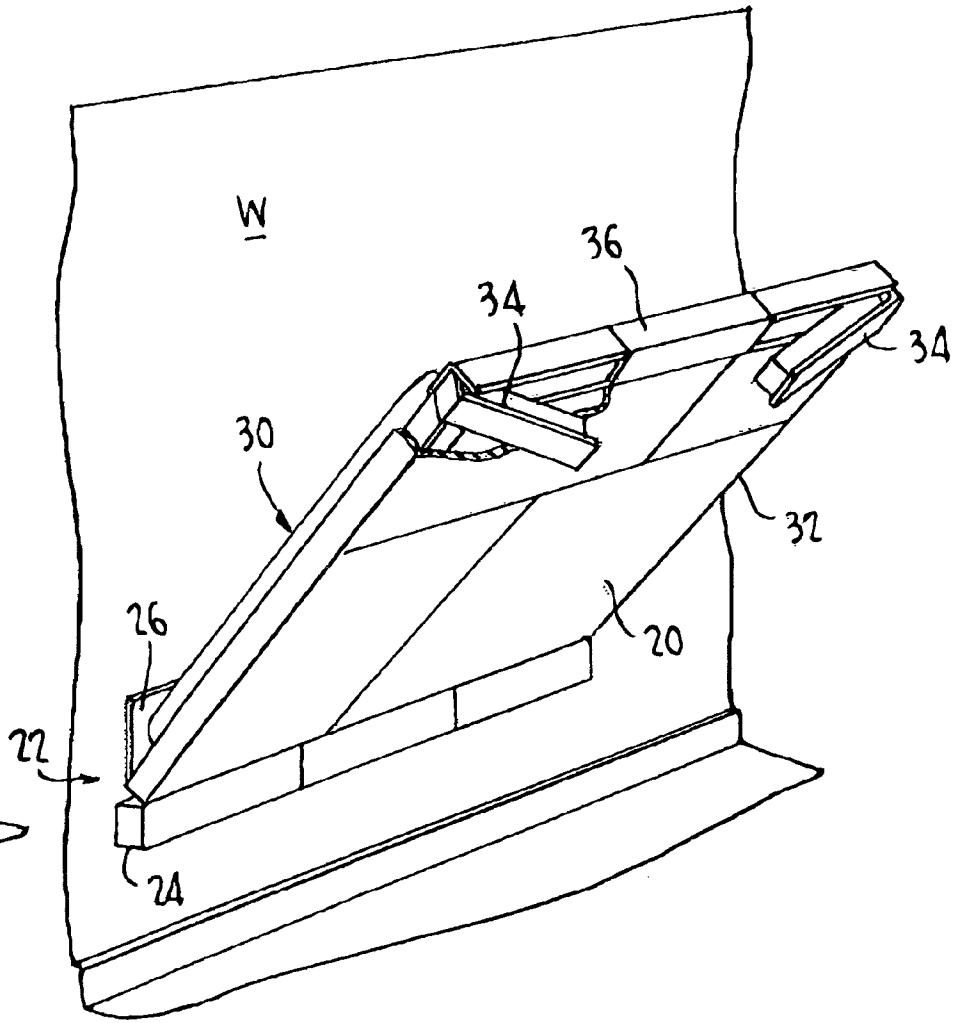
FIG. 2 is a perspective view of the combined wall treatment and bed of the present invention as the bed is being lowered from a vertical stowed position.
Figure 1:
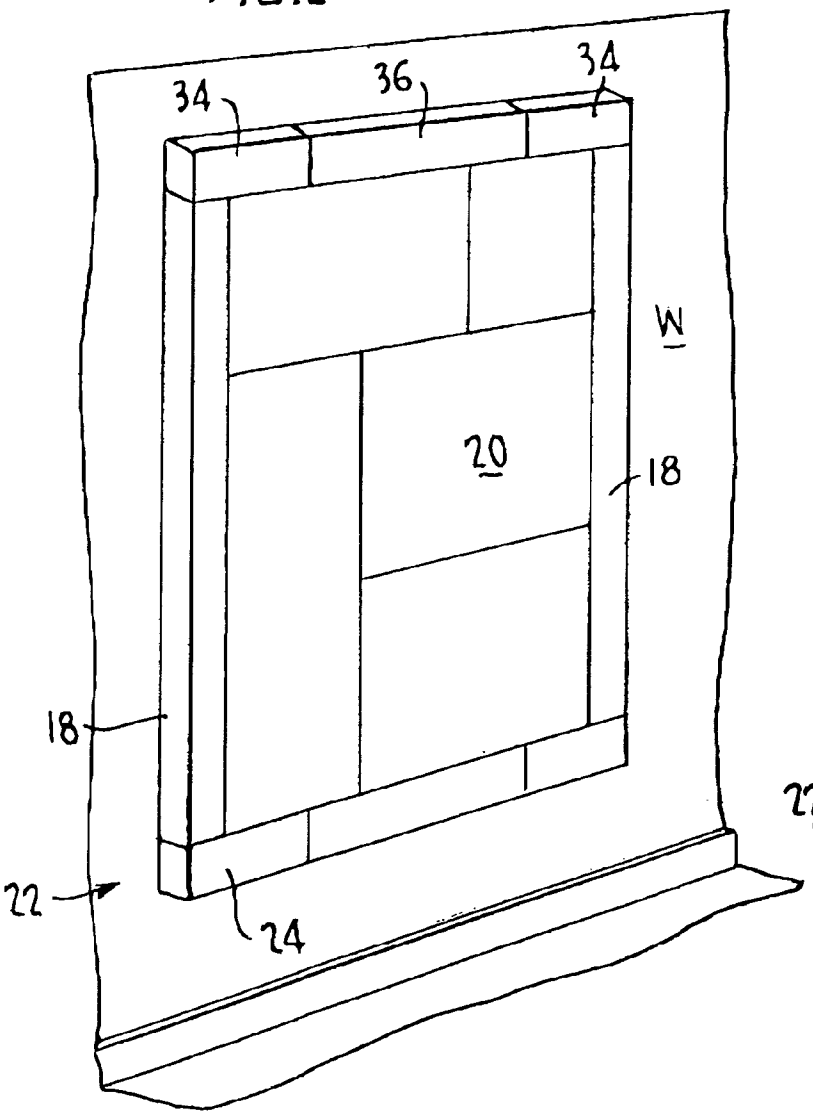
FIG. 1 is a perspective view of the present invention of the combined wall treatment and bed of the present invention in a vertical stowed position.
Figure 3:
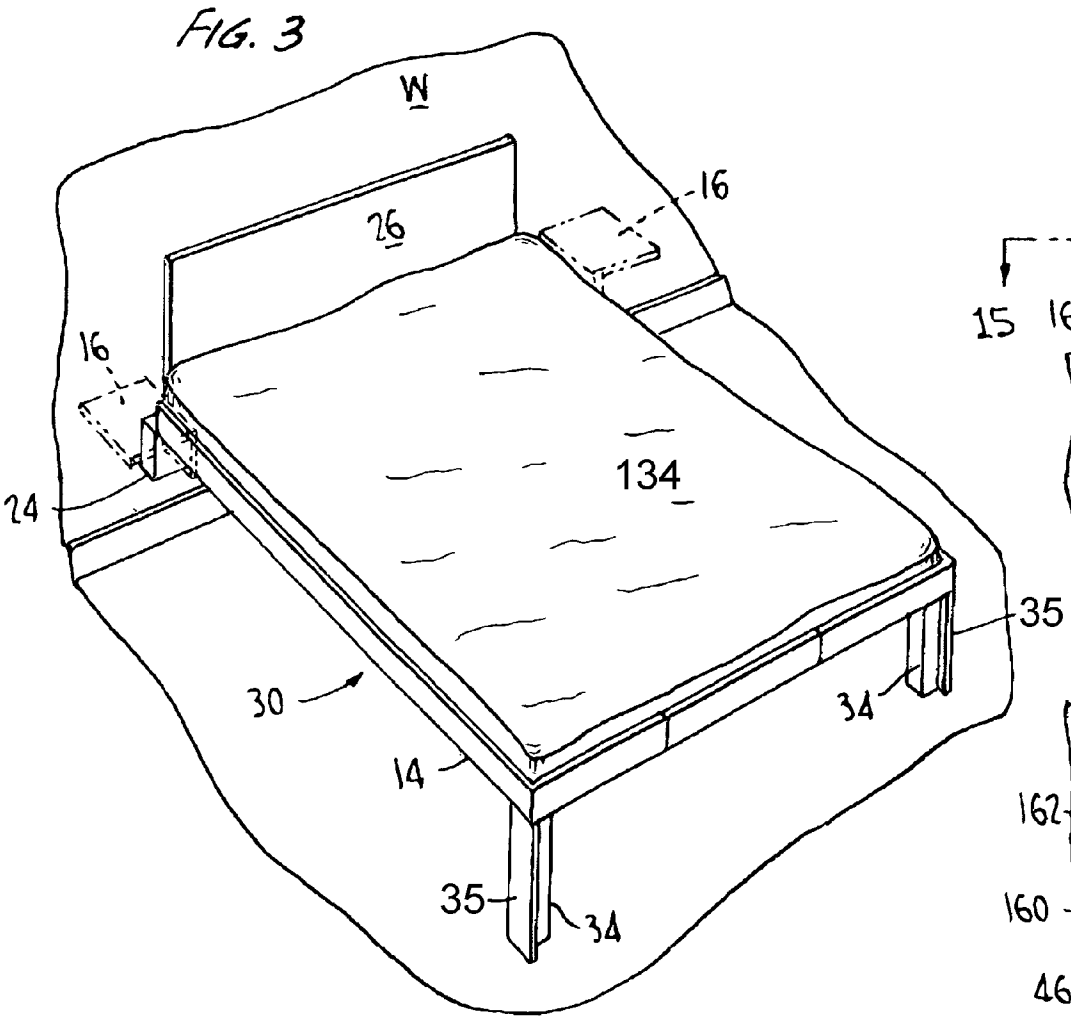
FIG. 3 is a perspective view of the combined wall treatment and bed of the present invention in the lowered or sleep position with the mattress inflated, and with side tables attached.

Referring now to the drawings and in particular to FIGS. 1, 2, and 3, these show overall views of the combined wall treatment and bed of the invention (sometimes "the unit" hereafter) in several positions. Specifically, FIG. 1 shows the unit in its raised and stowed position, in which it appears as a wall treatment. In this embodiment, the outer face or façade 20 of the unit, which forms the underside of the unit when lowered for sleeping, is shown as a paneled face. All manner of flat surface treatments may be applied to façade 20, including, without limitation, wood paneling, artwork, fabrics, bulletin boards, black- or white-boards, and the like. It is also within the invention to provide means for readily replacing one form of surface treatment with another, to enable easy redecoration. FIG. 2 shows the combined wall treatment and bed of the present invention in an intermediate position, as it is being lowered to the sleep position or raised to the stowed position. FIG. 3 shows the combined wall treatment and bed of the present invention in the lowered or sleep position, with the preferred hybrid foam/air mattress 134 in inflated position and optional side tables 16 clipped onto side rails 14, the structure of which is detailed below.

FIGS. 1-3 show that the unit comprises a fixed portion 22, comprising a bottom frame 24 and headboard 26, which are fixed to the wall W, and a movable portion 30, comprising a platform section 32, the outer surface of which is façade 20, legs 34, and a top frame 36. Movable portion 30 pivots around a horizontal axis defined by a mechanism (detailed below) comprised by the bottom frame 24. As illustrated in FIG. 2, the legs 34 swing out as the movable portion is lowered, pivoting about longitudinal axes near the sides of the platform section 32, to support the outer or foot end of the platform section 32 in the lowered position, and retract likewise when it is raised. More specifically, the overall effect as illustrated in FIG. 1 is to completely conceal the mechanical components of the unit of the invention, disguising the legs 34, which move out of the plane of the façade 20, and the bottom frame 24, which remains essentially stationary as the movable portion of the bed is pivoted downwardly into the sleep position, as part of the wall treatment.

As illustrated by FIG. 1, when the platform section 32 is raised to the vertical closed position, legs 34 are aligned with top frame 36; preferably the legs have a treatment 35 so that legs 34 and top frame 36 are finished similarly, and so that the legs 34 appear to be part of the top frame 36, so that together with the bottom frame 36 they form a decorative "frame" or "border" for the façade. Façade 20 may be provided with vertical side members 18, which cooperate esthetically with the bottom frame 24, legs 34 and top frame 36 to effectively provide a complete visual frame for the internal portion of façade 20. The top frame 36 cooperates with the legs 34 when the platform 44 is in its raised position, while the remaining mechanism is concealed in the bottom frame 24 and in the platform 32, concealed beneath the façade 20. In this way, the owner is given freedom to choose whatever decorative treatment he or she likes for the façade 20, with the legs 34, side members 18, and top and bottom frames 36 and 24 forming part of the design or framing it, as desired. For example, the façade 20, legs 34, side members 18 and top and bottom frames 36 and 24, respectively, can all be finished identically, e.g., in wood veneer, giving the appearance of a paneled wall. The clearance necessary to allow movement of the various components can be provided by narrow decorative gaps or "reveals" between the members. As illustrated in FIGS. 2 and 3, the legs may be rotated out from behind concealing panels, or, as shown in FIG. 1, the entire leg assembly may rotate as one.

The overall visual effect is that when one looks at the unit in the vertical position there is little to give away that it is also a comfortable bed.

Figure 4:
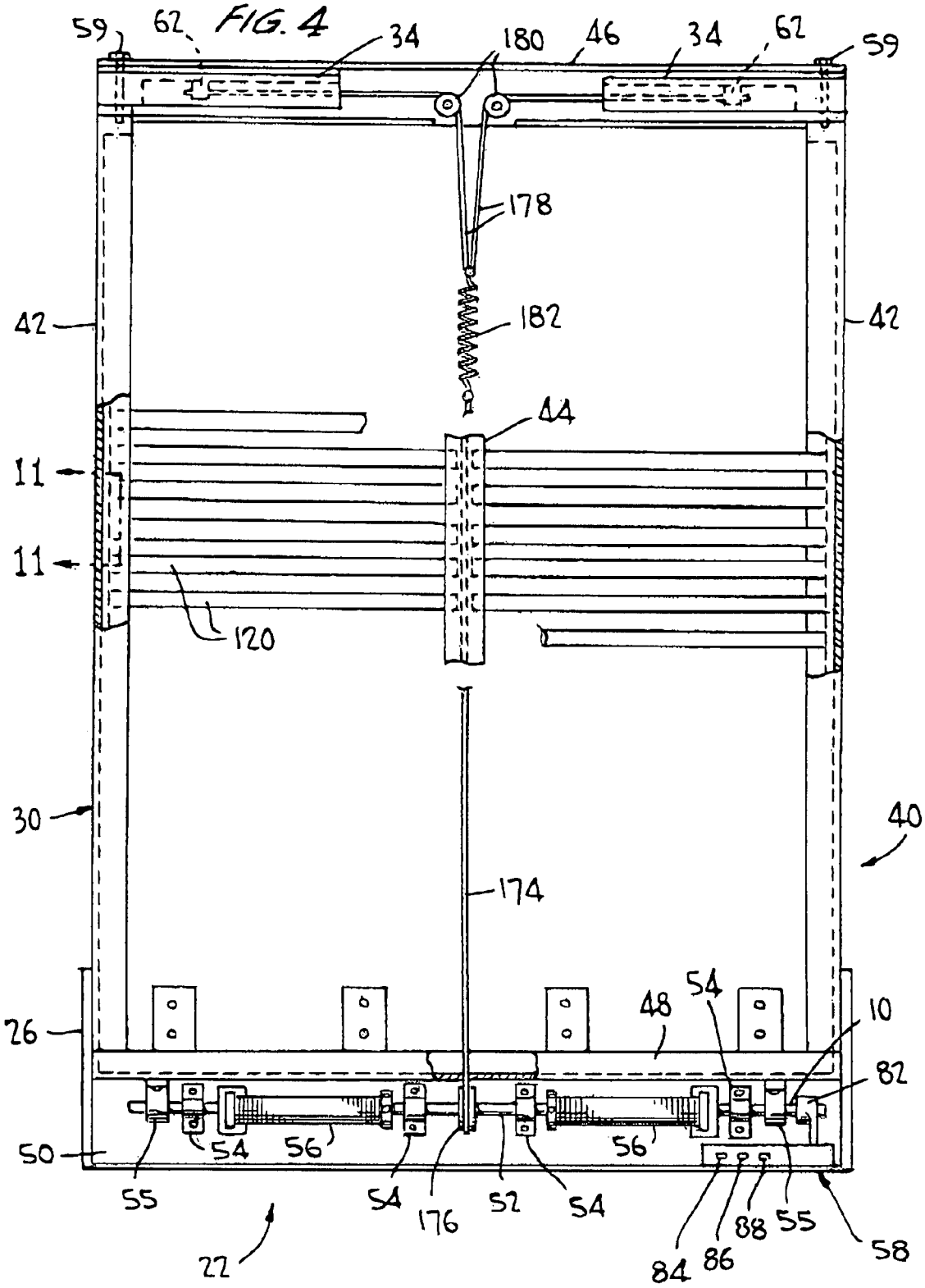
FIG. 4 is an elevational view of the bed frame in the vertical stowed position, with the outer façade removed showing the frame, hinge plate with leg articulating mechanism, axle, bearings, torsion springs, and damper.
Figure 5:
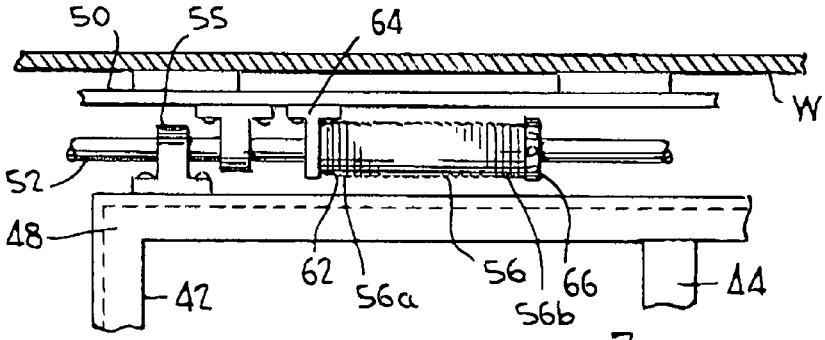
FIG. 5 is a partial plan view of the unit in the lowered sleep position, showing a portion of the frame, the bearings, and torsion spring mechanism.

FIG. 4 shows an elevational view of the principal components of one embodiment of the mechanism, as if looking at the unit in the vertical position, with the façade removed, and with the slat assembly which supports the sleep system shown partially cut away. FIG. 5 shows a more detailed view, in plan, of the torsion spring system, which counterbalances the weight of the unit, easing the work of raising and lowering it between upright and stowed and sleep positions. In another embodiment, discussed in detail in connection with FIG. 20 below, the torsion spring arrangement shown can be replaced by one or more gas spring(s); implementation of the gas spring, or another mechanical device for storing energy as the bed is lowered and releasing it as the bed is raised, is considered to be within the skill of the art. In each case the energy-storing device need simply be connected between the fixed and moving portions of the bed of the invention so as to store mechanical energy, as by compressing a gas, tensioning a spring, lifting a weight, or the like, as the bed is lowered, and releasing the stored energy as the bed is raised, easing this task. All manner of mechanisms for doing so are considered within the claims of this application where not specifically excluded.

As illustrated in FIG. 4, in one embodiment of the invention the movable portion 30 of the unit comprises a frame 40, comprising side rails 42, a central rail 44, and top and bottom members 46 and 48 respectively. Typically, and without limiting the invention, these will be fabricated of steel or aluminum angle stock, tubing, an aluminum extrusion or the like, provided (apart from central rail 44, which is unseen) with wood veneer concealing members or the like. The fixed portion 22 of the unit comprises a wall plate 50, secured to the wall as described below, which supports an axle 52 mounted in pillow blocks 54. The axle 52 is secured to lower member 48 of frame 40 by brackets (or additional pillow blocks) 55, such that the movable portion 30 of the unit and the axle 52 pivot together with respect to fixed portion 22 about the axis defined by axle 52. In the embodiment shown, but to which the invention is not to be limited, torsion springs 56 fitting concentrically over axle 52, and detailed further below, counterbalance the weight of the unit.

More specifically (see FIG. 5), one end 56*a* of each torsion spring 56 is secured to the wall plate 50 by a bracket 64 and a cone 62 fitting over the axle 52, allowing the torsion spring 56 to rotate freely around axle 52. The other end 56*b* of the torsion spring 22 is secured to the axle 52 by a second cone 66, secured to the axle 52. Thus, because one end 56*a* of the torsion spring is fixed to the wall plate 50, and the other end 56*b* of the torsion spring 56 rotates with the movable portion of the unit, the torsion spring is twisted tighter, creating resistance (storing energy) as the frame is lowered, and the energy is released as the bed is raised, easing the work of doing so. The torsion spring assembly thus effectively counterbalances the weight of the unit.

The precise amount of counterbalancing desired can be obtained by adjusting the relative position of the end 56*b* of the torsion spring with respect to the axle 52, effectively adjusting the amount of preload applied to the spring. The adjustment should be such that the unit can be lifted with ease by a slight person, for example, so that about ten total pounds of force are required, and so that the unit is held upright against the wall by the torsion springs.

Figure 8:
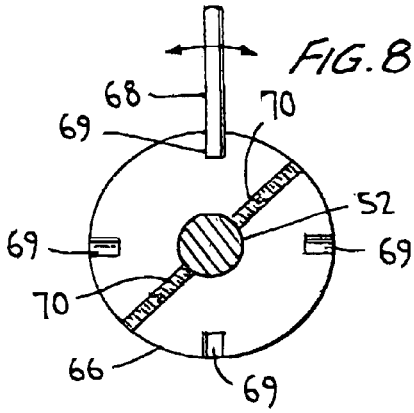
FIG. 8 is a side view of the torsion spring cone centered on the axle with adjusting slots, adjusting lever and setscrews.

The preload applied by the springs 56 can be adjusted as shown in FIG. 8, an end view showing axle 52 and cone 66, to which end 56*b* of spring 56 is affixed. The preload is effected by turning cone 66 with respect to axle 52, e.g., employing a spanner wrench or like tool 68 fitting into bores 69 in cone 66 to exert torque on cone 66, and locking cone 66 to axle 52 where desired using setscrews 70. Another possibility would be a ratcheting system, which can be easily adjusted and released. These particular embodiments are not meant to limit the torsion spring adjustment systems useful in implementation of this invention.

Figure 9:
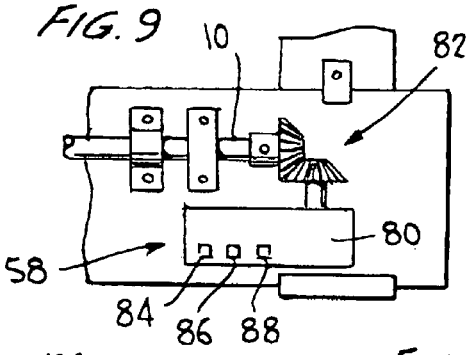
FIG. 9 is an elevational view, comparable to FIG. 4, showing the damper and 90 degree right angle joint in additional detail.

A damper system 58 mounted to the wall plate 50 and secured to axle 52 limits the rate of rotation of the axle 52 with respect to the wall plate, thus controlling the motion of the unit between the upright and stowed position and the sleep position. FIG. 9 shows the damper system 58, which controls the rate of descent as the bed is being lowered and also slows its ascent as the bed approaches the upright position. In this embodiment, a known hydraulic rotary damper 80, typically employed as a door closer, is used; in order to accommodate the existing hydraulic damper in the space available, the axis of rotation of the axle 52 must be redirected though 90.degree., e.g., using a pair of bevel gears 82. The damper 80 used in this embodiment has three adjustment screw valves 84, 86, 88 which, when the unit is used as a door closer, control the door to prevent slamming while ensuring reasonably rapid opening, and so on. As used herein, valve 84 controls the descent of the unit as it descends to a horizontal position, while valve 86 controls the rate of descent as the unit approaches the floor, beginning about 18 inches from the horizontal. Wall approach valve 88 controls rate of rotation of the unit as it is being lifted and approaches the vertical, starting about two feet before it approaches the wall in the upright position; that is, as the work required to be done by the torsion springs is reduced as the unit approaches the vertical, i.e., as the springs have less work to do per degree of rotation, the damper prevents the unit from moving too fast, which could lead to, e.g., fingers getting caught in the mechanism, and might be noisy. Thus, wall approach valve 88 controls the movement of the bed as it approaches the wall. Provision of the damper 80 thus adds safety and control both when the bed is being lowered, keeping it from dropping too quickly, hitting the floor hard, or slamming up against the wall as it is moving upright.

In the preferred embodiment of the invention, legs 34, which support the foot end of the unit in the sleep position, are deployed automatically as the unit is lowered and are similarly retracted as it is raised. As shown in FIG. 4, legs 34 are mounted to the top frame member 46 at pivots 59. Their automatic deployment and retraction can be accomplished in a wide variety of ways within the scope of the invention. In one preferred embodiment shown and detailed further below one or more tension cables retract the legs when the unit is raised, while springs urge the legs outwardly as it is lowered. Thus, as the unit is raised or lowered, the legs are retracted or deployed accordingly. Preferably, the mechanism is over-center in that the legs are moved beyond the vertical when deployed, such that they cannot be retracted without lifting the unit and will not buckle and collapse inwardly when loaded.

Figure 6:
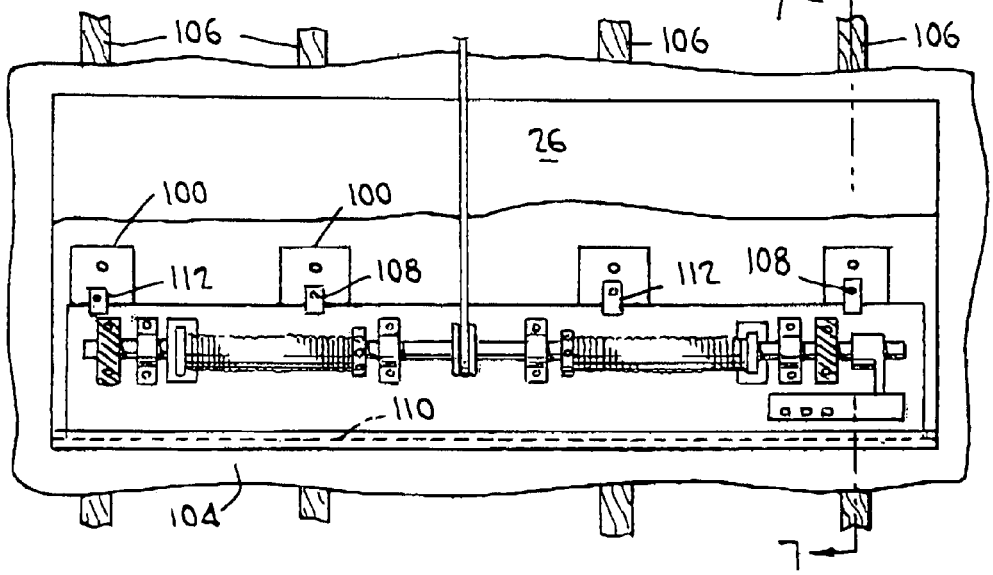
FIG. 6 is an elevation view of the wall attachment plates as attached to a standard stud wall construction, showing the studs, and of the mechanical hinge plate secured to the wall attachment plates and supporting the pivoting axle, bearings, torsion springs, leg deployment mechanism, and damper.
Figure 7:
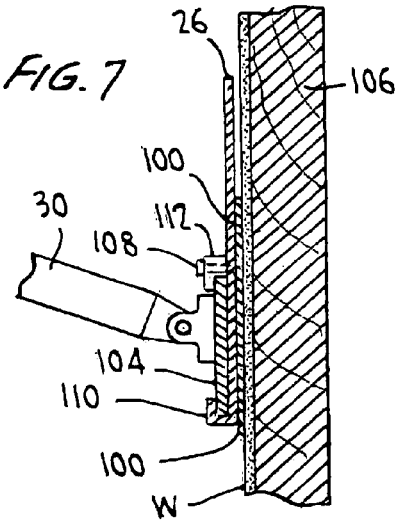
FIG. 7 is a cross-sectional view along line 7-7 of FIG. 6.

FIGS. 6 and 7 show the preferred method of attaching the bottom frame and headboard to the wall W. In this embodiment, and assuming a standard stud-and-drywall wall construction, one or more wall attachment plates 100 are first secured to the structural elements in the wall W, that is, to wooden or metal studs 106, and a hinge plate 104, which carries the pillow blocks and other components discussed above, is then secured to the wall attachment plates 100. This is preferred for reasons of ease of installation, although it is within the scope of the invention to secure the hinge plate 104 directly to the wall W. The wall attachment plates 100 are attached along a straight line a given dimension, typically one foot, off the floor, such that the head of the bed is parallel to the floor when open. In a further option, the wall attachment plates 100 could comprise first members to be secured to the studs and second members to be attached thereto, to which the hinge plate is in turn attached; the second members could be made vertically adjustable with respect to the first members, for ease in leveling the hinge plate. Likewise, the wall attachment plates 100 should be securable to the hinge plate 104 at any position therealong, to ensure secure mounting even if the studs are not evenly spaced. In the embodiment shown, the lower edge of the hinge plate 104 is lowered into a J-shaped channel 110 formed integrally with or fixed to wall attachment plates 100. The upper edge of the hinge plate 104 is then secured to the wall plates 100 with screws 108 and clips 112. A headboard 26 can be provided to conceal the wall attachment plates.

Figure 11:
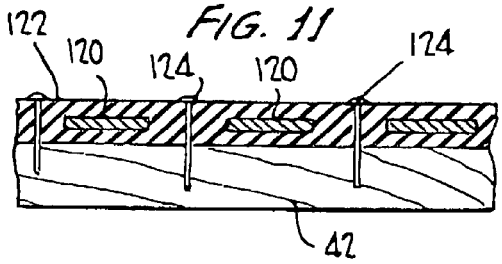
FIG. 11 is a cross-section on line 11-11 of FIG. 4, showing the rubber cambered slat receivers with attaching screws and bed frame.
Figure 10:
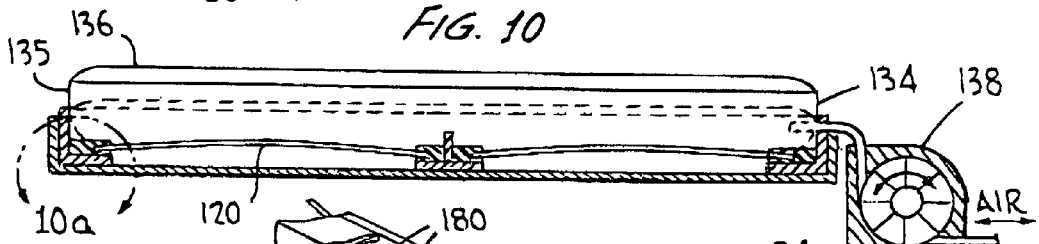
FIG. 10 is an end view of the sleep system assembly, showing the slats and foam/air hybrid mattress, wherein the inflatable portion of the mattress is shown in full as inflated for use and in dotted lines as deflated for storage.
Figure 10A:
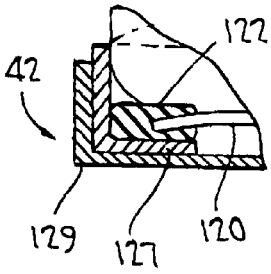
FIG. 10*a* is a detail of the assembly of FIG. 10.
Figure 12:
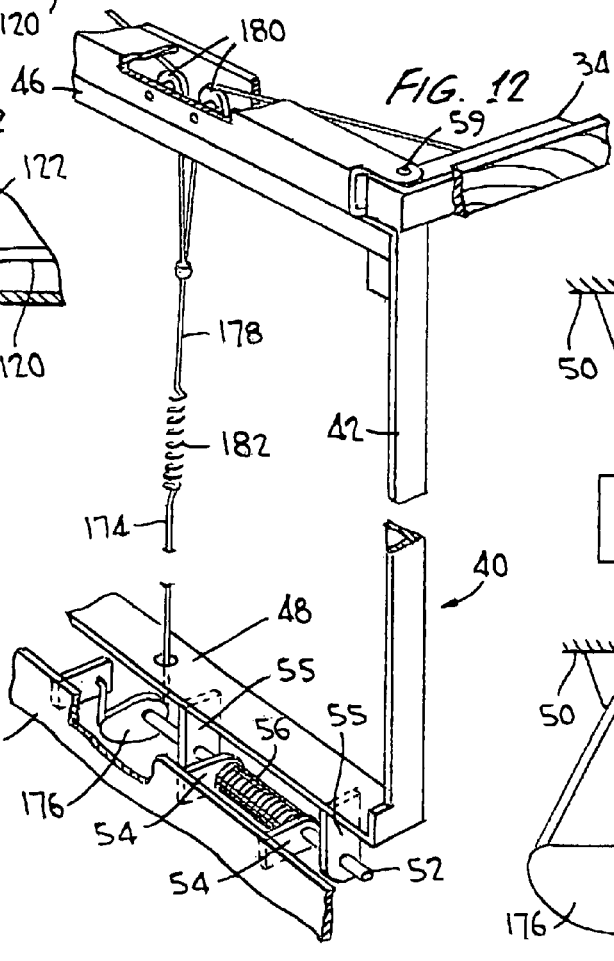
FIG. 12 is a perspective view showing the overall arrangement of one embodiment of the leg actuation mechanism.

FIGS. 10, 10*a*, and 11 show the cambered slat sleep suspension system, which provides comfort by absorbing movement and pressure, following the contours of the body. In this embodiment, cambered slats 120 are made of thin (⅜) inch hardwood plywood laminated over curved forms to have a camber of ⅜ inch over the length of the slat. The slats are about 3" wide in this embodiment. The slats 120 could also be made of other flexible materials such as fiberglass, metals, or plastics, and could be of differing dimensions. As illustrated in FIGS. 4, 10, and 11, rubber strips 122 are molded to define receptacles to receive the ends of the slats 120 while allowing the slats to move and flex somewhat, absorbing the shifting pressure when the bed is in use. The molded rubber strips are held in place by screws 124 extending into the side rail 42 (see FIG. 11). As shown in FIG. 10*a*, the frame may comprise a metal member 127 for strength, concealed by a wooden molding 129.

FIG. 10 also shows the preferred combined air/foam mattress 134, in dotted lines in the deflated condition and in full as inflated when in a sleep position. This mattress 134 is made of an airtight bladder filled with a compressible fiber/foam material 135 with a thinner layer (e.g., one inch thick) 136 of foam forming a topper. This creates the feel of a natural foam mattress, without the uncomfortable "roll" encountered with conventional air mattresses. Preferably the mattress 134 is automatically inflated as the unit is operated to take the sleep position and deflated, by applying a vacuum to the interior of the mattress, as the unit is raised. Deflating the mattress by application of vacuum compresses the fiber and foam components within the air bladders of the mattress. Thus the mattress, which can be as much as seven inches thick and very comfortable when inflated, is compressed to about 2½ inches thick when deflated, reducing the overall thickness of the bed of the invention, as is critical to its appearance as an attractive wall treatment when in the vertical position. Inflation and deflation can be accomplished using a bi-directional air pump 138, connected to the mattress 134 and arranged to be operated automatically upon motion of the movable portion of the unit with respect to the fixed portion. While this embodiment uses the hybrid fiber/foam inflatable component with a foam topper, one could use a simple air mattress to accomplish the same thing. Further, of course, while this embodiment uses an electric air handling system one could use a foot pump or other means of inflation and deflation.

FIGS. 12-15 show one preferred embodiment of a mechanism for automatically lowering the legs 34 as the movable portion of the unit is lowered to the sleep position, and for retracting the legs as it is raised. In this embodiment, the legs are spring-biased toward the deployed position, and are pulled back to the retracted position against the spring bias when the movable portion of the unit is raised. Other arrangements for providing similar automatic operation of the legs are within the skill of the art.

Figure 14:
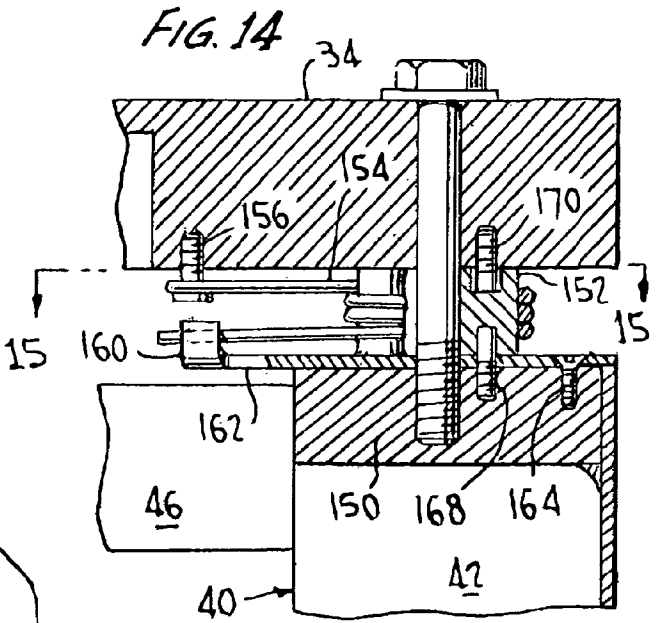
FIG. 14 shows the assembly of one of the legs to the frame of the unit.
Figure 15:
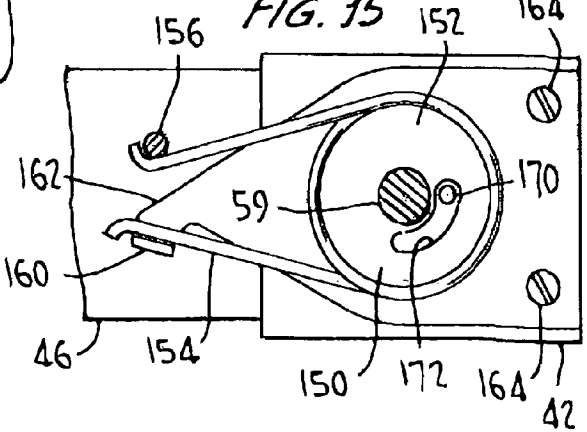
FIG. 15 is a cross-sectional view taken along line 15-15 of FIG. 14.
Figure 13A:
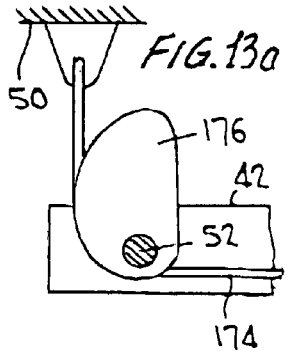
FIG. 13, comprising FIGS. 13*a* and *b*, shows a detail of a cam assembly employed to cause the legs to retract upon raising the movable portion of the unit from the sleep position, as in FIG. 13*a*, to the upright and stowed position, as in FIG. 13*b;*
Figure 13B:
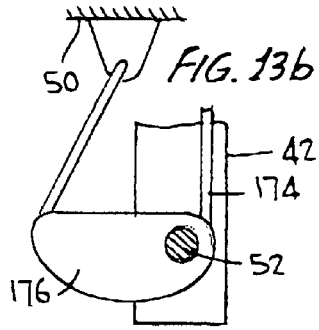

As noted above, FIG. 12 is a perspective view showing the overall arrangement of one embodiment of the leg actuation mechanism, in which a cam 176 mounted on axle 52 controls a cable 174 which retracts the legs against the spring bias. FIG. 13, comprising FIGS. 13(*a*) and (*b*), shows a detail of the cam assembly, wherein FIG. 13(*a*) shows the cam assembly when the unit is in the sleep position, and FIG. 13 (*b*) shows the position of the cam assembly with the unit in the upright and stowed position. FIG. 14 shows the assembly of one of the legs to the frame of the unit, and FIG. 15 is a cross-sectional view taken along line 15-15 of FIG. 14. Legs 34 are shown as solid members, for simplicity, but of course the invention is not to be thus limited. The structural loads applied to legs 34 could be carried by extruded aluminum members sheathed in a ornamental treatment to match or complement the treatment of the underside of the bed. For example, the legs could be sheathed in veneered composite material. The sheathing applied could also be made readily removable, so that the appearance of the bed could be conveniently altered as desired.

As shown, the legs 34 pivot about axes running generally along the sides 42 of the frame; a bolt 59 (one leg assembly being shown in FIGS. 12, 14, and 15; the other being minor-imaged) secures each leg 34 to the frame 40, e.g., being threaded into a block 150 welded to the side frame 42. A bushing 152, e.g., of high-density plastic material, spaces the leg 34 from block 150, provides low-friction pivoting of the leg, and provides a pivot about which hairpin spring 154 is retained. Spring 154 is arranged to exert an outward bias on leg 34, that is, to rotate it clockwise in FIG. 15, by exerting bias between a pin 156 fixed to leg 34 and an ear 160 on a bracket 162 fixed to frame 40, e.g., by screws 164 extending into block 150.

It is desirable to limit the degree to which the leg 34 pivots outwardly responsive to the bias of spring 154, to ensure that the leg solidly supports the foot end of the unit when in the sleep position. One way to accomplish this is shown in FIGS. 14 and 15. A first pin 168 extends between mating bores in bushing 152 and block 150, preventing rotation of bushing 152, and a second pin 170 extends from a bore in leg 34 into an arcuate recess 172 in bushing 152, limiting the degree of rotation permitted to leg 34.

As noted, a cable 174 is provided to retract the legs 34 against the bias of spring 154 when the movable portion of the unit is raised to the vertical stowed position. As illustrated, one end of cable 174 is secured with respect to the wall plate 50, so that as the movable portion is raised, rotating axle 52, cable 174 is wound upon a cam 176 secured to axle 52. The opposite end of cable 174 is bifurcated, as indicated at 178, and passes over sheaves 180 secured to the top member 46 of frame 40 so as to simultaneously control the motion of both legs 34. A spring 182, of higher spring value than spring 154 (after consideration of the various mechanical advantages provided), but having its travel limited, is disposed along cable 174 to keep positive tension on cable 174, so that the legs are securely retained when the movable portion of the unit is in its upright position.

FIGS. 16-19 show an alternative mechanism for automatically deploying and retracting the legs as the bed is lowered and raised, respectively. In this case the legs are operated by a rigid rod member 200. Member 200 is driven in push-pull fashion by a mechanism shown in FIGS. 18 and 19. Motion of member 200 is communicated to the legs by flexible slide members 202, which are fabricated of a flexible material capable of exerting force without buckling in both tension and compression, such as strips of fiberglass, and by further rigid members 208, secured to slide members 202 at 210. Flexible members 202 slide within guides 204, while rigid members 208 are constrained to back-and-forth movement by headed bolts extending through slots 208*a* in members 208. Members 208 are then pivotally secured to legs 34 by bolts 212. Thus, as member 200 is urged back and forth, legs 34 are pivoted in and out; legs 34 may again be provided with springs biasing them to the deployed position, to ensure that that any slack in the mechanism does not result in the failure of the legs to fully deploy.

Figure 18:
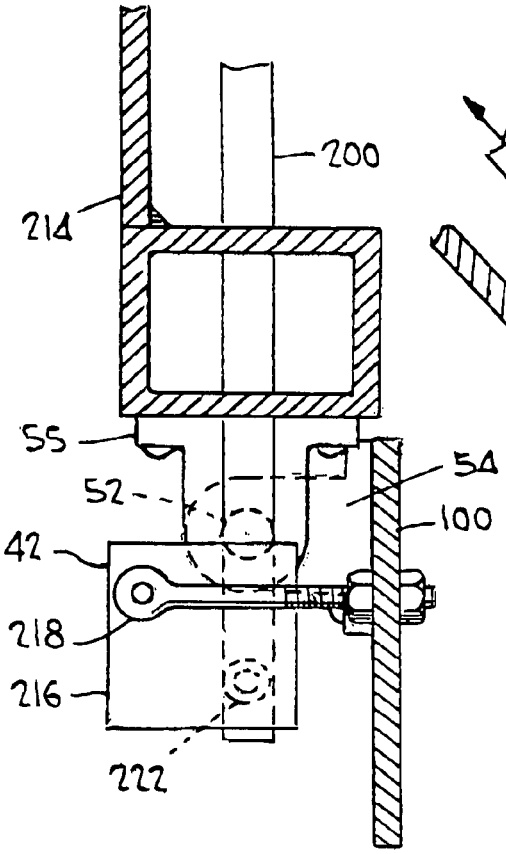
FIGS. 18 and 19 show a portion of the leg articulation mechanism of FIG. 16, with the bed in the stowed and partially-deployed positions, respectively.
Figure 19:
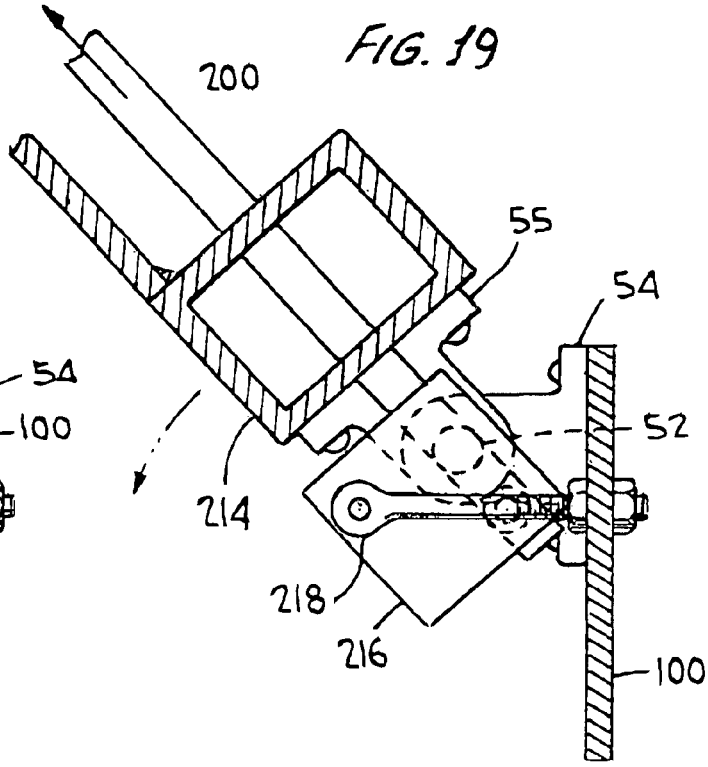

One method of providing back and forth motion to member 200 as the bed is raised and lowered is shown by FIGS. 18 and 19. The axis about which bed frame pivots as it raised and lowered is defined by axle 52, located with respect to the wall by a first bearing (or set of bearings) 54 and with respect to the bed frame by a second bearing 55. A bracket 216 secured to the sliding member 200 at 222 pivots with respect to a bolt 218, fixed with respect to the wall, as the bed frame is raised and lowered. As the pivot point defined by axle 52 is not collinear with the pivot point defined by bolt 218, as the bed is lowered the sliding member 200 is forced outwardly, away from axle 52, causing the legs to be deployed; as the bed is raised the opposite occurs, pulling the legs back into their inactive position.

Figures 16, 16A, 17:
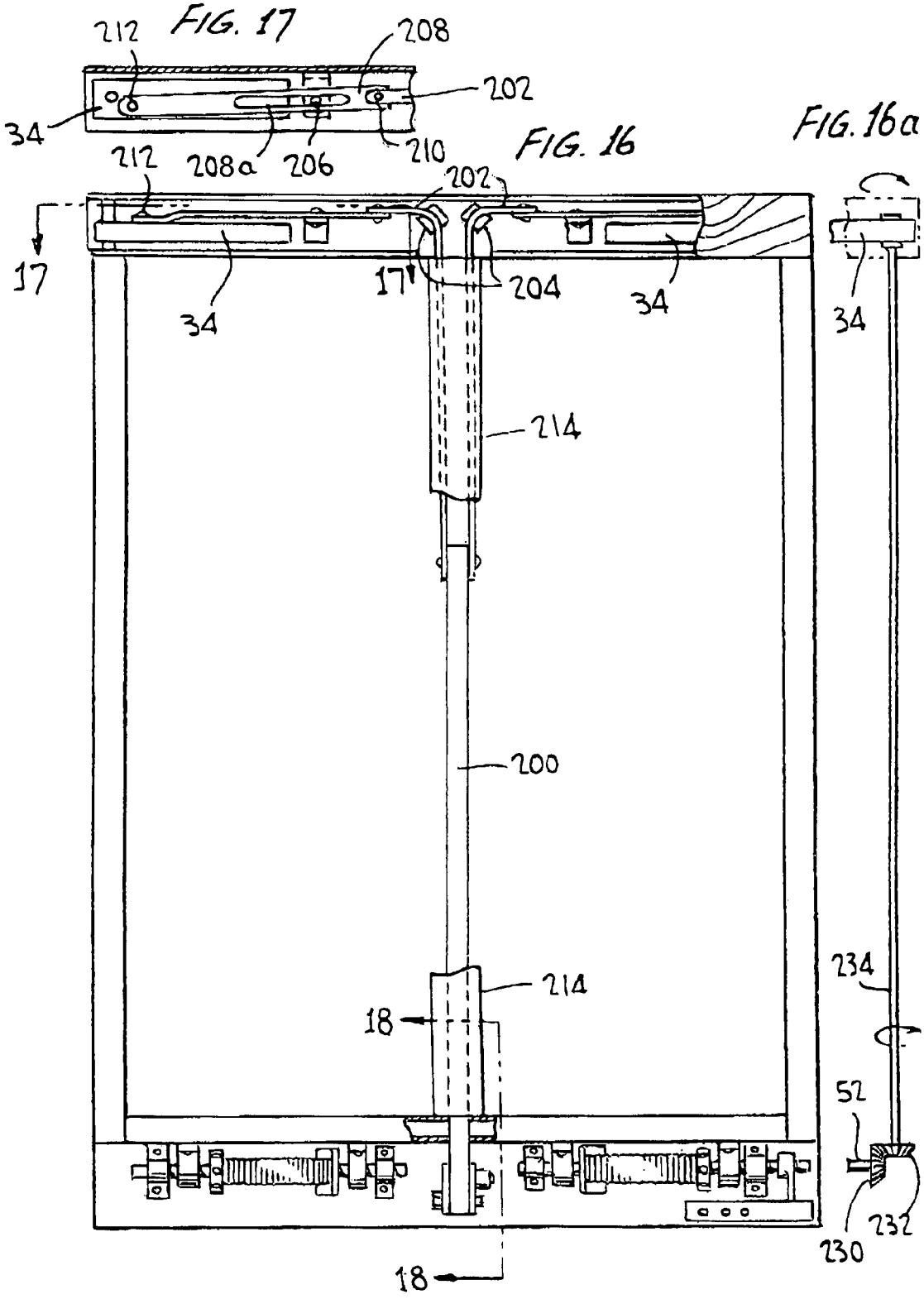
FIG. 16 is a view comparable to FIG. 4, illustrating an alternative mechanism for articulating the legs.
FIG. 16*a* shows a further alternative thereto.
FIG. 17 is a partial plan view corresponding to the adjacent portion of FIG. 16.

A further mechanism for automatically deploying and withdrawing the legs is shown by FIG. 16A; here bevel gears 230 on either end of axle 52 simply drive a mating pair of gears 232 mounted on shafts 234 running along the outer edges of the bed frame, and arranged to operate the legs 34 as desired.

Figure 20:
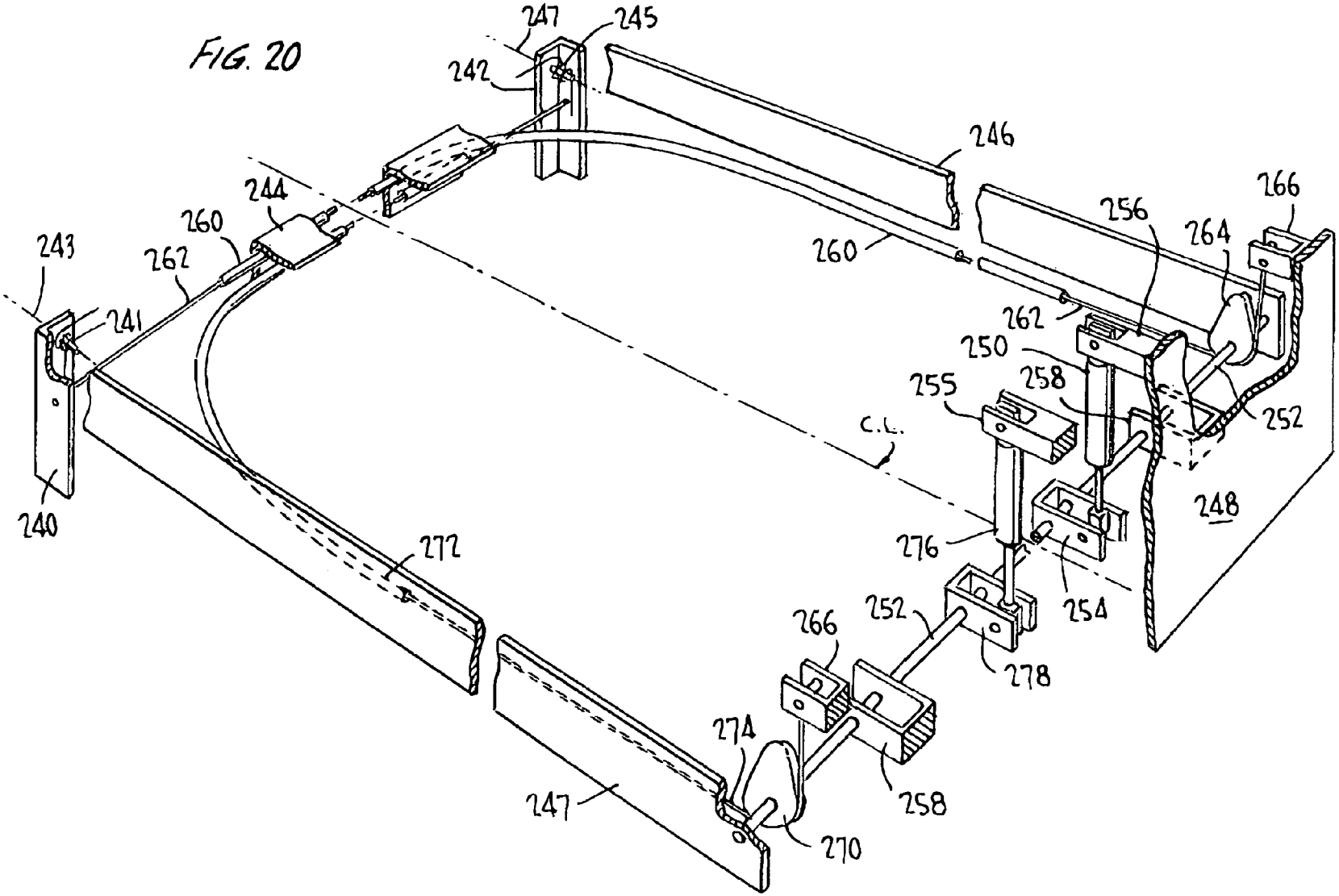
FIG. 20 shows a perspective schematic view of another embodiment of the leg actuation mechanism.

FIG. 20 shows schematically a further mechanism for automatically deploying and withdrawing the legs as the bed is lowered and raised. (The decorative sheathing that would normally be provided on the frame members and legs is omitted from this view for clarity.) In this design, as illustrated, individual leg-lifting cables run from the legs to respective actuating mechanisms on the opposite side of the bed. The actuating mechanisms comprise cams, generally similar to that shown in FIGS. 13*a* and *b*, while the energy-storage and damping functions are both provided by one or more gas springs, effecting a further simplification.

More specifically, in this embodiment the bed pivots about an axis defined by a continuous axle or two stub axles 252 supported by bearing brackets 258, which would typically be mounted on a wall plate 248 secured to a wall (not shown). Left and right legs, 240 and 242 respectively, are pivoted about axes 243 and 247, and are operated by cables 262 and 274 confined in sheaths 260 and 272. One end of each cable is fixed to the corresponding leg and the other end is fixed with respect to the wall plate 248 and hence the wall by a bracket 266. Cables 274 and 262 are tensioned by cams 270 and 264 as the bed is raised from its lowered position in FIG. 20 to the vertical position, pulling legs 240 and 242 into the plane of the bed frame comprising side frames 247, 246 and foot member 244. If the axles 252 are spaced sufficiently from the wall plate 248 it may be possible to dispense with the cams. Conversely, as the bed is lowered, tension in the cables is released, and hairpin springs 241, 245 (the complete leg attachment mechanism possibly being as shown in FIGS. 14 and 15) urge the legs to their deployed position.

In the FIG. 20 embodiment, as the bed is lowered energy is stored in one or more gas springs 276, 250 (a pair being shown), connected between crank arms 278, 254 fixed to pivot axles 252 and brackets 255, 256 fixed to wall plate 248; this energy is released as the bed is raised, easing the work of doing so. Gas springs suitable for this application and in which the rate of travel is controlled are commercially available, so that the gas springs can also be used to limit the rate of motion of the bed, eliminating the need for a separate damper as shown in other embodiments discussed above.

Other suitable mechanisms for thus automatically deploying and withdrawing the legs as the bed is lowered and raised are within the skill of the art and are intended to be included within the scope of this invention.

A further improvement that is within the scope of the invention is to provide a further mechanism for lowering the decorative façade covering the portion of the unit that is fixed to the wall as the movable portion is pivoted toward the sleep position, and raising it correspondingly; this would allow the sections of the decorative façade covering the fixed and movable portions of the unit to fit closely to one another, which would be esthetically desirable. This could be accomplished in the FIG. 20 embodiment by mounting this portion of the façade for vertical sliding motion over a range of up to a few inches, and actuating its motion by a mechanism operated by rotation of axles 252.

It is also within the invention to employ the mechanical design of the unit of the invention into a stowable bed intended for use where space-conservation is important but esthetics are less so, such that the unit need not comprise a decorative façade. For example, the unit of the invention could be incorporated in a hospital-room cabinet, to provide temporary accommodation for patients' visitors and the like.

While a preferred embodiment of the invention has been described in detail, this is exemplary only and the invention is not to be limited thereby.

What is claimed is:

1. A combined decorative wall treatment and piece of furniture, comprising: a wall anchor component, to be fixed to a wall without contacting a floor, and comprising pivot structure defining a fixed horizontal pivot axis; and a generally planar movable component, comprising: a first end that is pivotally connected to the wall anchor component; a second end, opposite the first end, that swings free; a frame comprising pivot structure, at the first end of the moveable component, that cooperates with the wall anchor pivot structure such that the movable component pivots about the fixed horizontal pivot axis between: a vertical position, in which the movable component extends upward from the fixed horizontal pivot axis, is juxtaposed to the wall, and does not contact the floor, so that the combined decorative wall treatment and piece of furniture contacts only the wall, and no part of the combined decorative wall treatment and piece of furniture touches the floor; and a horizontal position, in which the movable component extends outward from the wall and reveals a surface of the furniture; a decorative panel mounted to a display side of the movable component, the decorative panel comprising an outer face that faces outward from the wall when the movable component is in its vertical position and downward toward the floor when the movable component is in its horizontal position, the decorative panel further comprising side faces extending backward from the outer face toward the wall, the decorative panel thereby enclosing the frame and the furniture surface when the movable component is in its vertical position; a counterbalance mechanism coupled between the wall anchor component and the movable component, such that energy is stored by the counterbalance mechanism as the movable component is lowered to its horizontal position, and such that said energy can be released in order to assist in raising the movable component to its vertical position; and at least two supporting legs pivotally attached at proximal ends to the frame at the second end of the moveable component.

2. The combined decorative wall treatment and piece of furniture of claim 1, wherein the wall anchor component comprises at least one plate adapted to be attached to existing wall structure.

3. The combined decorative wall treatment and piece of furniture of claim 2, further comprising a headboard concealing the at least one plate.

4. The combined decorative wall treatment and piece of furniture of claim 1, wherein the counterbalance mechanism comprises a torsion spring, one end of which is fixed to the wall anchor component and the other end of which is rotated by movement of the movable component as it is pivoted between its horizontal and vertical positions, such that the torsion spring stores energy as the movable component is moved to its horizontal position and releases energy as said generally planar movable component is raised to its vertical position.

5. The combined decorative wall treatment and piece of furniture of claim 4, further comprising a damper controlling the rate of lowering and rate of rise of the movable component as it is pivoted between its horizontal and vertical positions.

6. The combined decorative wall treatment and piece of furniture of claim 1, wherein the legs are drawn into a retracted position by one or more flexible cables responsive to motion of the movable component from the horizontal to the vertical position.

7. The combined decorative wall treatment and piece of furniture of claim 1, wherein the combined decorative wall treatment and piece of furniture extends 4.5 inches or less from the wall when the movable component is in its vertical position.

8. The combined decorative wall treatment and piece of furniture of claim 1, wherein the legs pivot between a closed position in a plane of the decorative panel and an open position perpendicular to the plane.

9. The combined decorative wall treatment and piece of furniture of claim 8, wherein the legs pivot in a plane perpendicular to the plane of the decorative panel.

10. The combined decorative wall treatment and piece of furniture of claim 8, wherein the movable component further comprises a top decorative border on the frame's display side, the top decorative border being aligned with the legs and having a width matching a width of the legs, so that the top decorative border and the legs, when the legs are closed, form a border visually framing the decorative panel.

11. The combined decorative wall treatment and piece of furniture of claim 10, further comprising a bottom decorative border affixed to the wall below the wall anchor component, the bottom decorative border having a width matching the top decorative border's width and contributing to the border visually framing the decorative panel.

12. The combined decorative wall treatment and piece of furniture of claim 11, wherein the outer face of the decorative panel comprises side members extending from the legs to the bottom decorative border and having widths that match that of the legs and top and bottom decorative borders, so that the top decorative border, the bottom decorative border, the legs, and the side members provide a complete border visually framing the decorative panel.

13. The combined decorative wall treatment and piece of furniture of claim 1, wherein the furniture comprises a bed, and the furniture surface is provided by a mattress assembly supported by the frame, the mattress assembly comprising a mattress support structure fixed to the frame and a mattress carried by the mattress support structure so that it faces inward toward the wall when the movable component is in its vertical position and upward, away from the floor, when the movable component is in its horizontal position.

14. The combined decorative wall treatment and piece of furniture of claim 13, wherein the mattress comprises an airtight bladder filled with a compressible fiber or foam material, the mattress being inflatable for sleeping and deflatable to a thickness small enough to be fully concealed by the decorative panel when the movable component is in its vertical position.

15. The combined decorative wall treatment and piece of furniture of claim 14, further comprising an air handling system for automatically inflating the air bladder when the movable component is lowered to its horizontal position, and automatically deflating the air bladder by application of vacuum when the movable component is raised to its vertical position.

16. The combined decorative wall treatment and piece of furniture of claim 1, wherein the combined decorative wall treatment and piece of furniture lies flush to the wall when the movable component is in its vertical position.

17. The combined decorative wall treatment and piece of furniture of claim 1, wherein the wall anchor component is attached to an unrecessed portion of the wall.

18. The combined decorative wall treatment and piece of furniture of claim 1, wherein the fixed horizontal pivot axis is positioned away from the wall by brackets.

19. The combined decorative wall treatment and piece of furniture of claim 18, wherein the furniture surface is above the fixed horizontal pivot axis when the movable component is in its horizontal position, and the axis is positioned sufficiently far away from the wall to provide clearance for the furniture surface to pivot about the axis.

20. The combined decorative wall treatment and piece of furniture of claim 1, wherein the counterbalance mechanism comprises a gas spring which is actuated by movement of the movable component as it is pivoted between its horizontal and vertical positions, such that the gas spring stores energy as the movable component is moved to its horizontal position and releases energy as said generally planar movable component is raised to its vertical position.

* * * * *